US005133612A

United States Patent [19]

Yamazaki et al.

[11] Patent Number: 5,133,612

[45] Date of Patent: Jul. 28, 1992

[54] DOT IMPACT TYPE PRINTING HEAD WITH ADHESIVELY ATTACHED BASE UNIT

[75] Inventors: Mamoru Yamazaki, Anjyou; Akira Iriguchi, Nagoya, both of Japan

[73] Assignee: Brother Kogyo Kabushiki Kaisha, Nagoya, Japan

[21] Appl. No.: 760,479

[22] Filed: Sep. 16, 1991

[30] Foreign Application Priority Data

Oct. 3, 1990 [JP] Japan ..... 2-267219

[51] Int. Cl.[5] ..... B41J 2/235; B41J 2/295

[52] U.S. Cl. ..... 400/124; 400/157.1

[58] Field of Search ..... 400/124, 124 PZ, 124 TC, 400/157.1, 157.1 PZ; 101/93.05

[56] References Cited

U.S. PATENT DOCUMENTS

| | | | |
|---|---|---|---|
| 4,049,107 | 9/1977 | Murat | 400/124 |
| 4,589,786 | 5/1986 | Fukui et al. | 101/93.05 |
| 4,874,978 | 10/1989 | Sakaida et al. | 400/124 |

FOREIGN PATENT DOCUMENTS

| | | | |
|---|---|---|---|
| 57-34979 | 2/1982 | Japan . | |
| 145461 | 8/1983 | Japan | 400/124 |
| 63-17060 | 1/1988 | Japan . | |
| 89353 | 4/1988 | Japan | 400/124 |
| 63-312852 | 12/1988 | Japan . | |

*Primary Examiner*—Edgar S. Burr
*Assistant Examiner*—Stephen R. Funk
*Attorney, Agent, or Firm*—Oliff & Berridge

[57] ABSTRACT

In a print head of a dot matrix printer, support frames carrying the piezoelectric elements of the print wires are seated in and bonded to a base unit to provide a rigid, unitary printing structure. The base unit has projections extending therefrom which define grooves into which the support frames are received. An adhesive or solder is used to adhere the support frames to the base unit. Silicone rubber may also be used to fill gaps between the support frames and the base unit and between individual print units.

20 Claims, 9 Drawing Sheets

DOT IMPACT TYPE PRINTING HEAD WITH ADHESIVELY ATTACHED BASE UNIT

BACKGROUND OF THE INVENTION

1. Field of the Invention

The invention relates to a dot impact type printing head and, more particularly, to a dot impact type printing head provided with a plurality of print units having piezoelectric elements extended with application of a voltage.

2. Description of the Related Art

A dot impact type printing head having a plurality of print units is disclosed in Japanese Pat. Laid-Open Publication No. 63-312852. Each of the print units includes a piezoelectric element where a plurality of piezoelectric ceramics are bonded to each other in a laminated state, an extension transmitting mechanism for enlarging the extension of the piezoelectric element to drive a print wire, and a support frame for supporting the extension transmitting mechanism and the piezoelectric element. The plurality of print units are arranged radially inside the printing head. A first board is disposed at the rear end of the printing head, and a second board is disposed at the fore end of the printing head. The support frame of each print unit is secured to the first board by a bolt fastened in the longitudinal direction of the print unit, i.e., in the direction of the extension of the piezoelectric element. The support frame of each print unit is fixed to the second board by a bolt fastened in the direction perpendicular to the longitudinal direction of the print unit.

However, there is a possibility of generation of a longitudinal dimensional error in the support frame of the print unit or of manufacture error in flatness at the end surfaces of the first and second boards in contact with the support frame. Furthermore, variation in the fastening force may be generated in the bolt fastening operation. Therefore, deformation in the support frame may be caused in the above-mentioned printing head where both fore and rear ends of the support frame are fastened by the bolts. If the support frame is deformed to be extended in the longitudinal direction, the extension of the piezoelectric element is not exactly transmitted to the extension transmitting mechanism, thus reducing the impact force of the print wire. Moreover, in assembling the printing head, the support frame of each print unit must be fastened twice by the bolts, which is cumbersome and time consuming.

SUMMARY OF THE INVENTION

An object of the present invention is to provide a printing head where assembly of the support frames of print units does not result in their being deformed.

Another object of the present invention is to provide an easily assembled printing head.

To attain the above and other objects, a dot impact type printing head according to the present invention comprises a plurality of print units, each of which has a piezoelectric element extended with application of a voltage, an extension transmitting mechanism for transmitting the extension of the piezoelectric element to a print wire, and a support frame having a fore portion and a rear portion and supporting the piezoelectric element and the extension transmitting mechanism; a head unit to which the fore portions of the support frames of the print units are fixed; and a connector having a plurality of projections intruding between the rear portions of the support frames of the adjacent print units with the connector bonded to the plurality of print units by an adhesive that fills the gaps between the support frames and the projections.

In the dot impact type printing head according to the present invention, the rear portions of the support frames of the print units are secured to the connector by the adhesive during assembly of the printing head. Therefore, any dimensional error in the support frames can be eliminated by a change in thickness of the adhesive layer.

As mentioned above, in the dot impact type printing head according to the present invention, the adhesive can eliminate any dimensional errors so that the support frames of the print units are not deformed during assembly of the printing head. Further, the plural print units are immediately secured to the connector by the adhesive, thereby remarkably facilitating assembly of the printing head.

BRIEF DESCRIPTION OF THE DRAWINGS

Preferred embodiments according to the invention will be described in detail with reference to the following figures, wherein:

FIG. 2 is a side cross-sectional view of the printing head of FIG. 1;

DESCRIPTION OF THE PREFERRED EMBODIMENTS

Figure 1:
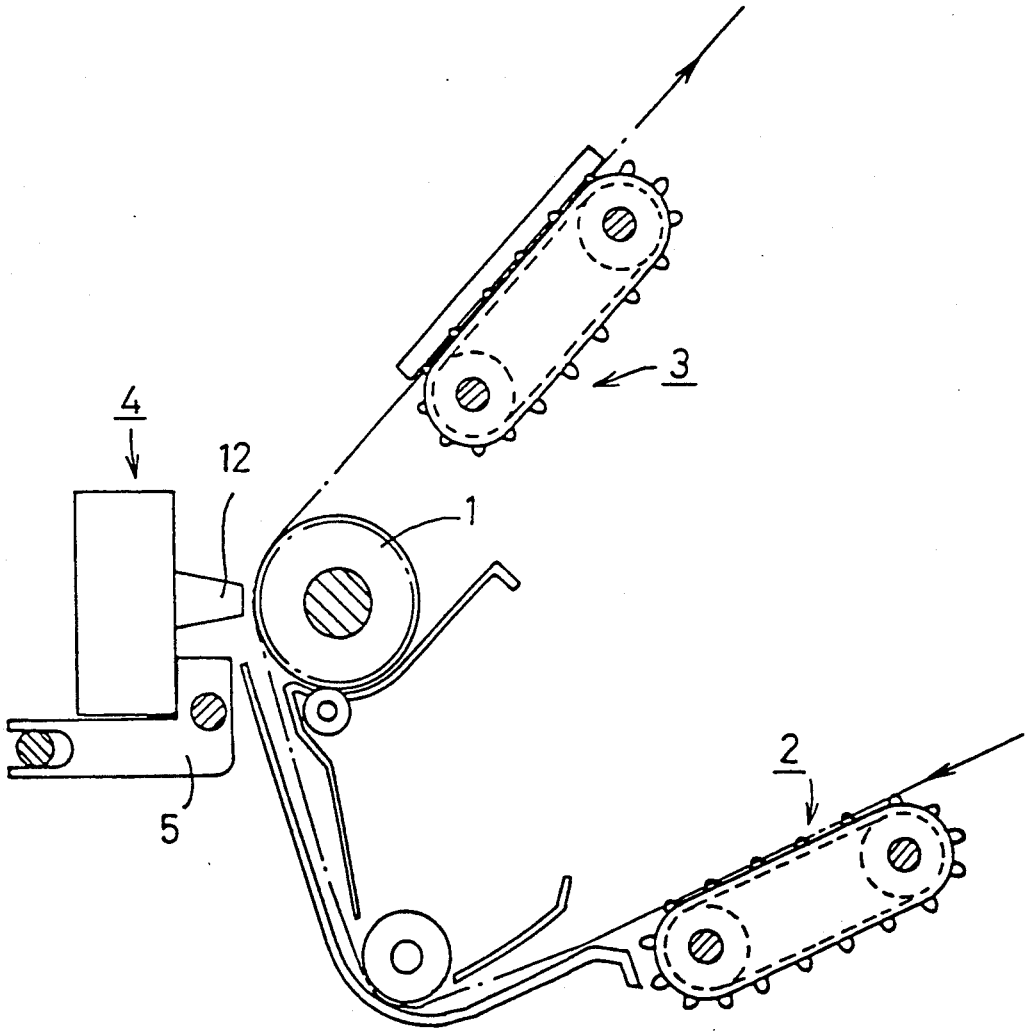
FIG. 1 is a schematic side view of a printer provided with a printing head of a first embodiment according to the invention.

A first preferred embodiment will be explained hereunder with reference to FIGS. 1 through 6. As shown in FIG. 1, a dot impact type printing head 4 has a nose portion 12 disposed opposite to a cylindrical platen 1 housed inside a printer. The printing head 4 is mounted on a carriage 5 to move reciprocally along the longitudinal direction of the platen 1. A push tractor 2 is disposed upstream and a pull tractor 3 is located downstream of the platen 1 with respect to the paper feed direction. The push and pull tractors 2 and 3 are driven in synchronism to feed the print paper.

As illustrated in FIGS. 2 through 6, the printing head 4 comprises, in a cylindrical form, a disk-shaped head unit 6 and a cylindrical cover, or base unit, 7 having a bottom. The head unit 6 and cover 7 are made of an aluminum alloy. A ring-shaped seal 29 made of rubber is interposed between the annular fore end edge of the cover 7 and an annular rear end edge 6*a* in the back of the head unit 6. Radiation fins 7*b* are formed in the periphery of the cover 7. Twenty-four print units 9 are radially arranged in the space enclosed by the head unit 6 and cover 7. Projecting from the front surface of the head unit 6 is a hollow nose portion 12 containing therein guide plates 11 for lengthwise guidance of the print wires 10 provided in the print units 9.

Each print unit 9 comprises a piezoelectric element 13 made of laminated piezoelectric ceramics; an extension transmitting mechanism 14 for enlarging the extension of the piezoelectric element 13 to drive the print wire 10; and a support frame 15 for supporting the extension transmitting mechanism 14 and piezoelectric element 13. The support frame 15 is integrally formed of a main support 15*a*, a sub support 15*b* and a rear end 15*c* providing a substantially U-shaped configuration to surround both the longitudinal sides and rear end of the piezoelectric element 13. The piezoelectric element 13 extends in the laminal direction, i.e., the longitudinal direction, with the application of a voltage. A temperature compensator 16 is disposed between the rear end 15*c* of the support frame 15 and the rear end of the piezoelectric element 13, for correcting the length of the piezoelectric element 13, which is liable to contract with an increase in temperature. The base portion of an arm 17 is fixed in a connector portion 21 that connects the tip end of a first plate spring 19 to the tip end of a second plate spring 20. The base end of the first plate spring 19 is attached to the side surface of the main support 15*a* while the base end of the second plate spring 20 is attached to the side surface of a movable piece 22 fixed in the fore end of the piezoelectric element 13. The extension transmitting mechanism 14 constitutes the arm 17, first plate spring 19 and second plate spring 20.

Figure 5:
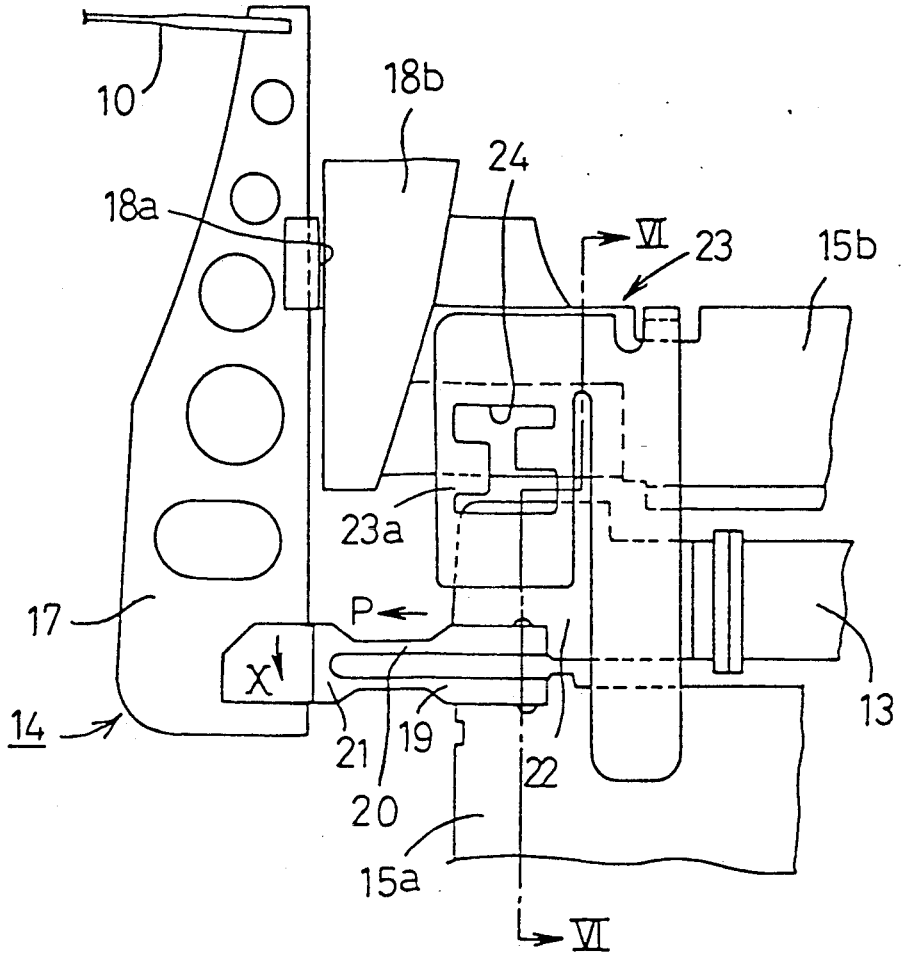
FIG. 5 is a partially enlarged side view of the print units of the printing head of FIG. 2.

As shown in FIG. 5, the piezoelectric element 13 extends with application of a voltage so that the movable piece 22 is moved in the direction indicated by an arrow P. The connector portion 21, connecting the tip ends of both plate springs 19 and 20, is therefore displaced in the direction indicated by an arrow X. The displacement of the connector portion 21 is enlarged by the arm 17 and transmitted to the print wire 10. Consequently, the print wire 10 is driven to be projected from the nose portion 12. Upon ending of the application of the voltage to the piezoelectric element 13, the arm 17 is shifted opposite to the direction indicated by the arrow X due to the elasticity of the plate springs 19, 20. As a result, a stopper 18*a*, made of resin, disposed at the lower end of the arm 17, abuts against a stopper 18*b* on the frame side mounted on the sub support 15*b* so that the arm 17 comes to a halt.

Figure 6:
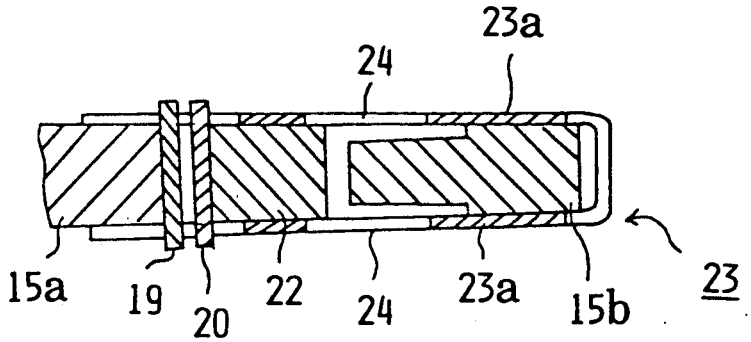
FIG. 6 is a cross-sectional view taken on line VI—VI of FIG. 5.

A quadric link mechanism member 23, shown in FIGS. 5 and 6, is disposed across the movable piece 22 and the sub support 15*b*, and is made of an elastic spring plate. In the wide side plates 23*a*, 23*a* of the quadric link mechanism member 23 are bored notches 24 each notch having an H-shape turned on its side. The top side, as viewed in FIG. 5, of the four sides of the wide side plate 23*a* surrounding the notch 24, is fixed to the sub support 15*b*; the bottom side is secured to the movable piece 22. The left and right sides of the wide side plate 23*a* are elastically deformed to inclined positions such that the outside edges of wide side plate 23*a* substantially define a parallelogram with the extension of the piezoelectric element 13. Consequently, the movable piece 22 moves parallel to the longitudinal axis of the sub support 15*b*.

Figure 2A:
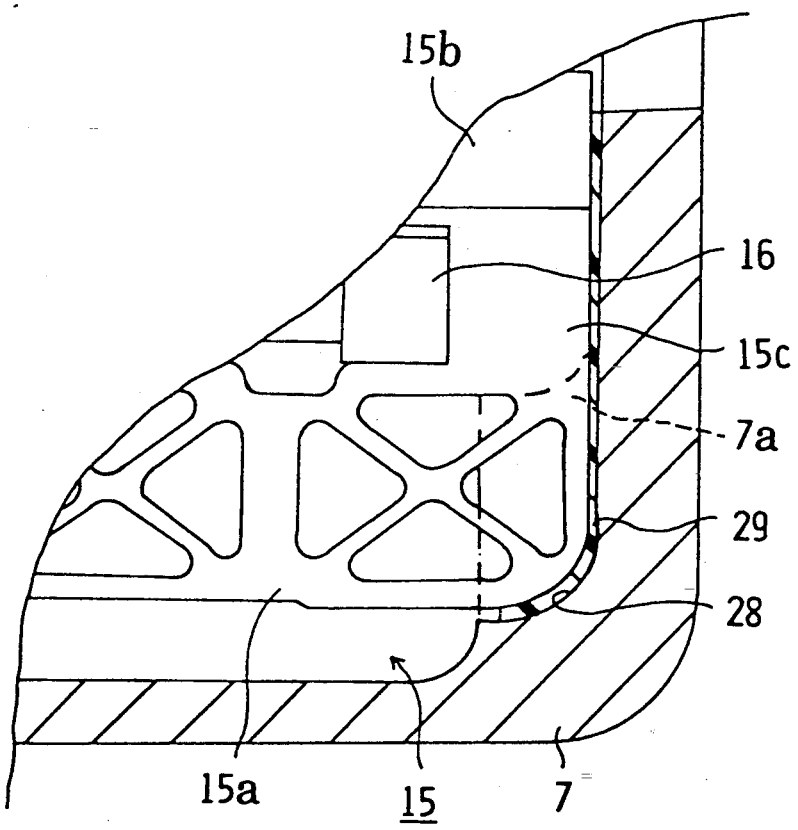
FIG. 2A is an expanded side cross-sectional view of a part of the printing head or FIG. 1.
Figure 3:
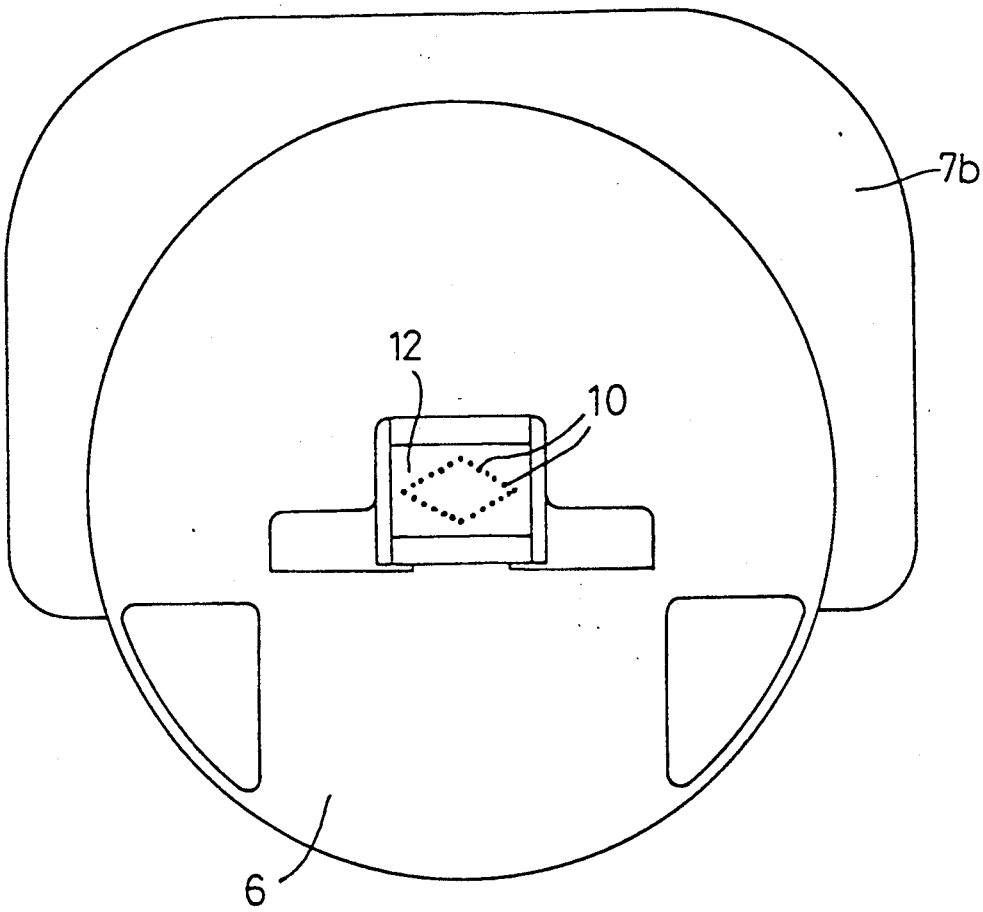
FIG. 3 is a front view of the printing head.
Figure 4:
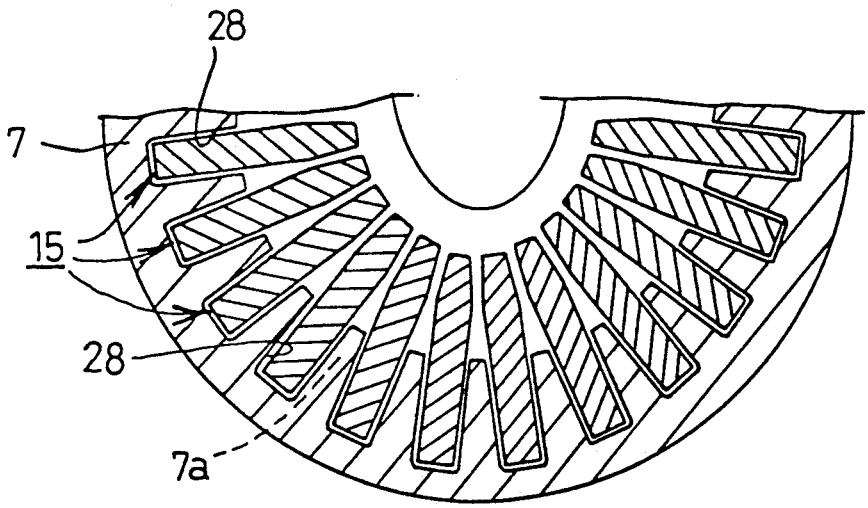
FIG. 4 is a partial cross-sectional view taken on line IV—IV of FIG. 2.
Figure 9:
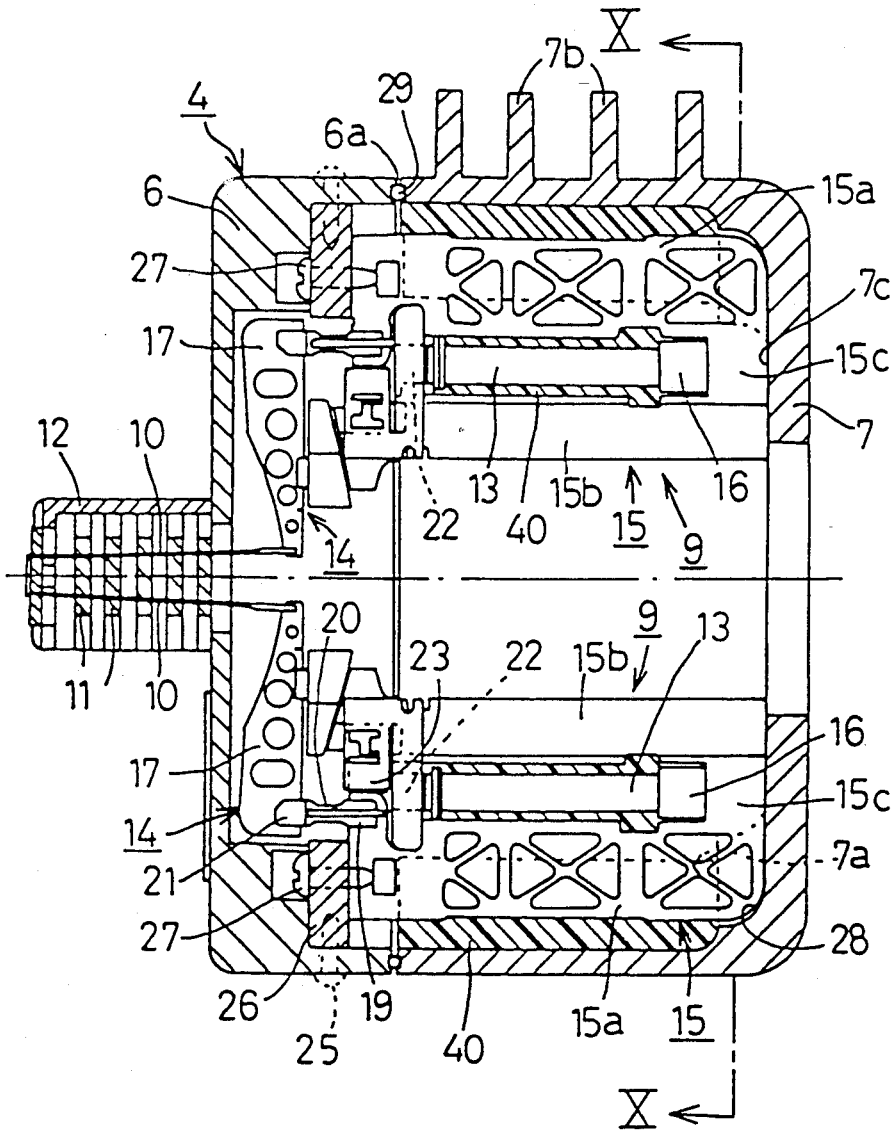
FIG. 9 is a side cross-sectional view of a printing head of a third embodiment according to the invention.

As depicted in FIGS. 2 and 9, an annular fixture piece 26 is fastened to the back of the head unit 6 by a bolt 25. The fore end of the main support 15*a* of each print unit 9 is secured to the back of the fixture piece 26 by a screw 27. A plurality of projection pieces 7*a* are radially formed at the bottom surface 7*c* of the cover 7 to serve as a connector. Each projection piece 7*a* is interposed between the support frames 15 of the adjacent print units 9 and disposed opposite to the rear end 15*c* of the support frame 15. In other words, a plurality of radial grooves 28 are defined by the plurality of projection pieces 7*a*, in the bottom surface 7*c* of the cover 7, and the rear ends 15*c* of the support frames 15 are inserted into the grooves 28. The rear end 15*c* of each support frame 15 is bonded to the adjacent projection pieces 7*a* and bottom surface 7*c* of the cover 7 by an adhesive 29 made of a thermoplastic resin such as an epoxy resin. Alternatively, the rear end 15*c* may be soldered or brazed to the adjacent projection pieces 7*a* and bottom surface 7*c*. In this way, the disposition of the projection pieces 7*a* prevent any separation of the support frames 15 from the cover 7 and increase the bonded area of the support frames 15 with respect to the cover 7.

Figure 7:
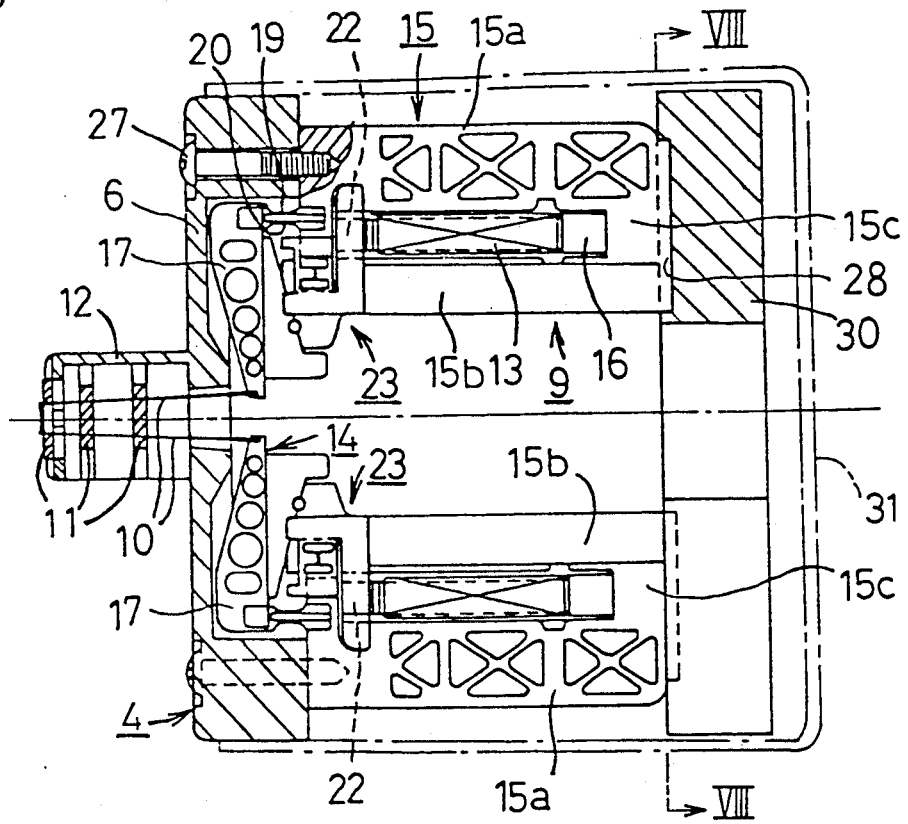
FIG. 7 is a side cross-sectional view of a printing head of a second embodiment according to the invention.
Figure 8:
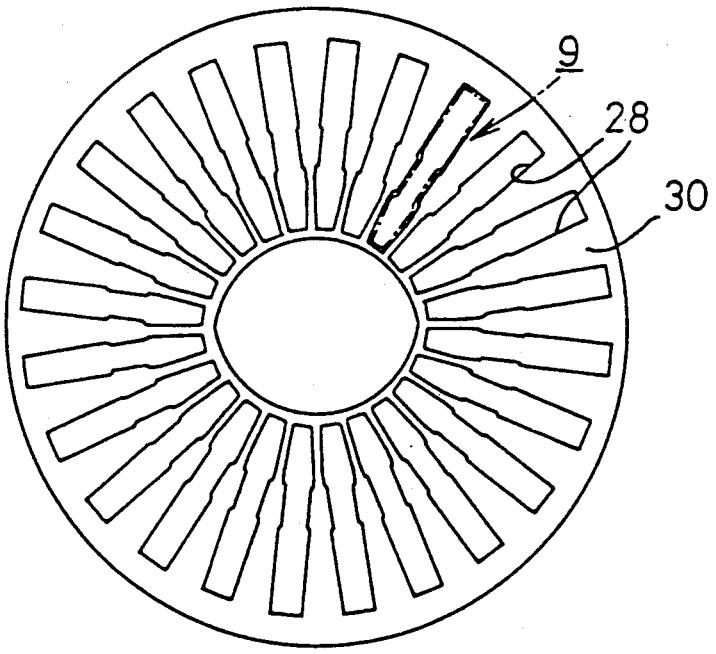
FIG. 8 is a front view of the connector of the printing head, taken on line VIII—VIII, of FIG. 7.

A second embodiment according to the invention will be explained hereunder with reference to FIGS. 7 and 8. In the second embodiment, a cover 31 is provided independently of a connector, or base unit, 30 having a substantially annular shape. A plurality of grooves 28, separated by projections therebetween, to define indentations, as they are enclosed by inner and outer circumferential rings of substantially the same height as the projections, are formed radially on the connector 30. The rear end 15*c* of the support frame 15 of each print unit 9 is inserted into a groove 28, to be bonded by the adhesive 29. The remaining structure is substantially the same as that of the first embodiment.

With the arrangements in the first and second embodiments described above, the rear ends of the support frames 15 of the plural print units 9 are bonded to the cover 7 or connector 30 and disposed thereon so that the plural support frames 15 are integral with each other via the bonding to the cover 7 or connector 30. Consequently, the rigidity of the print head is extraordinarily enhanced. For example, when the piezoelectric elements 13 in some of the 24 print units 9 are driven and the support frames 15 of the driven piezoelectric elements 13 would possibly be extended in the direction away from the back of the head unit 6 by the reaction force to moving the print wire 10 forward (such being the case in a conventional print head), the support frames 15 of the driven piezoelectric elements 13 are supported by the rigidity of the support frames 15 of the adjacent non-driven piezoelectric elements 13 and their fixed attachment to the cover 7 or connector 30. Accordingly, deformation is unlikely to result in the support frames 15 in comparison to the case where each print wire and its support frame must resist the drive reaction force of the piezoelectric elements 13. Thus, the insufficiency in impact force of the print wires 10 at the time of the drive of the printing head 4 is prevented.

Further, as the rear ends 15*c* of the support frames 15 are secured to the cover 7 or connector 30 by the adhesive, the thickness of the adhesive layer 29, formed between the rear ends 15*c* and the cover 7 or connector 30 is adjusted during assembly, thereby eliminating any dimensional error in the longitudinal direction of the support frames 15. The thickness of the adhesive layer 29 is adjusted for each support frame 15 when the extra adhesive is forced out of the groove where the rear end 15*c* of the support frame 15 is seated in the groove during final assembly, which is the attachment of cover 7 or connector 30 and cover 31, thus preventing any dimensional error. Consequently, no stress is generated in the support frames 15 during the assembly of the printing head 4 and unnecessary deformation is not generated in the support frames 15. As a result, any insufficiency in the impact force of a print wire is prevented.

Figure 10:
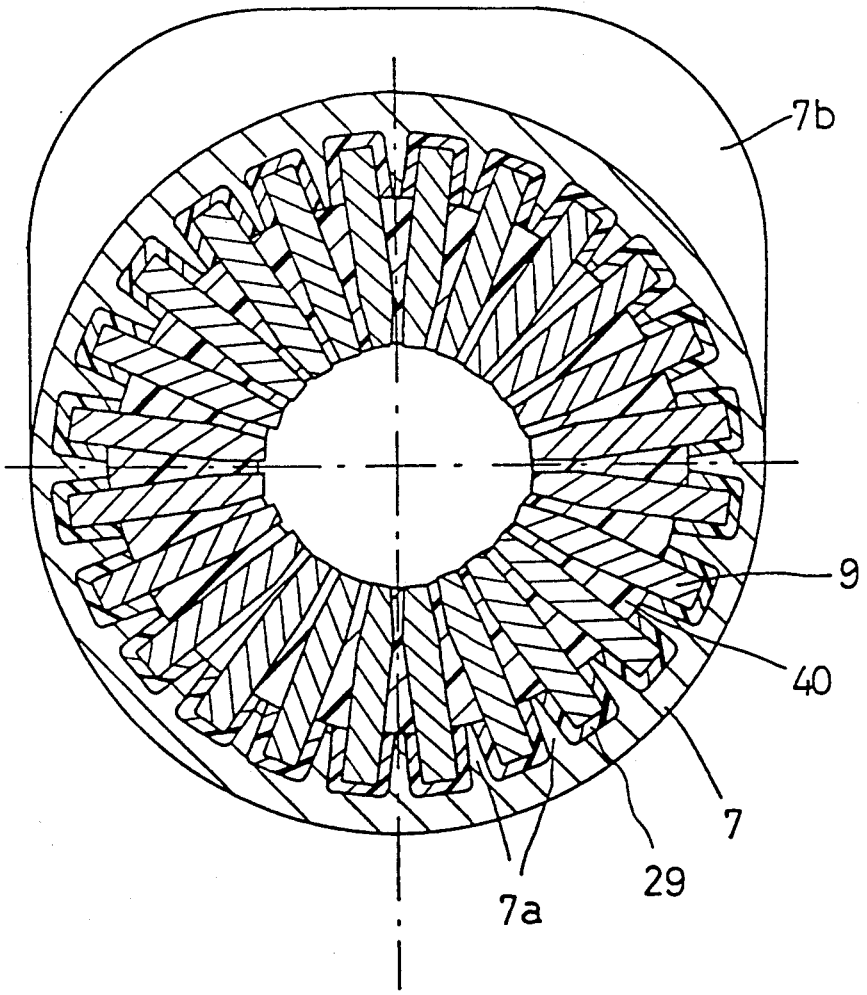
FIG. 10 is a cross-sectional view taken on line X—X of the printing head of FIG. 9.

Next, a third embodiment according to the invention will be explained with reference to FIGS. 9 and 10. In the third embodiment, the plurality of projection pieces 7*a* are formed on the bottom surface 7*c* of the cover 7 extending toward the open end of the cover 7 to define a plurality of grooves therebetween. Each projection piece 7*a* is positioned between the adjacent print units 9. In addition to the gap between the print unit 9 and the projection piece 7*a* which is filled with a synthetic resin having a high thermoconductivity such as silicone rubber 40, the area between adjacent print units is also filled with a synthetic resin. Heat generated in the print units 9 due to the drive of the piezoelectric elements 13 is transmitted to the cover 7 via the silicone rubber 40 and the projection pieces 7*a* to be radiated from the outer peripheral portion of the cover 7 and the radiation fins 7*b*. The filled silicone rubber 40 cannot prevent the extension of the piezoelectric element 13 even if it comes into close contact with the element 13 because of its elasticity. The remaining structure is substantially the same as that of the first embodiment, that is, the print units 9 are attached at their base ends to cover 7 by an adhesive 29.

Figure 11:
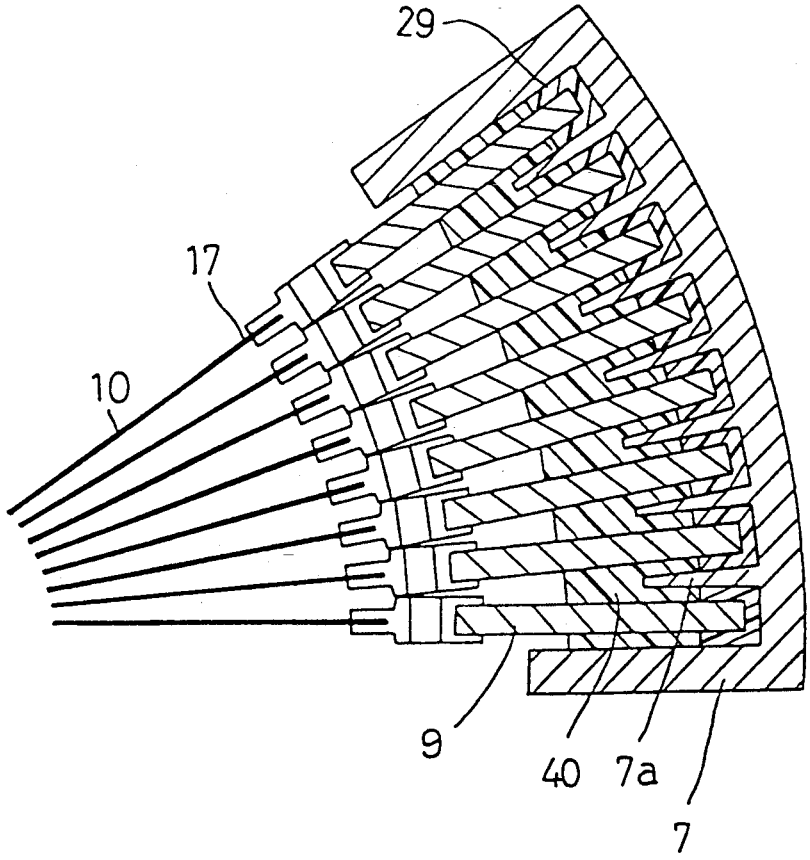
FIG. 11 is a cross-sectional view of a printing head of a fourth embodiment according to the invention.

A fourth embodiment of the invention will be described with reference to FIG. 11. In the fourth embodiment, the cover 7 is formed into a sector. The plurality of print units 9 are bonded to the cover 7 by the adhesive 29 in a vertical arrangement. At the inner surface of the cover 7 are formed the projection pieces 7*a* projecting between the print units 9. The gaps between the print units 9 and the projection pieces 7*a* are filled with the silicone rubber 40 in the same manner as in the third embodiment described above, as is a substantial portion of the gaps between adjacent print units.

Figure 12:
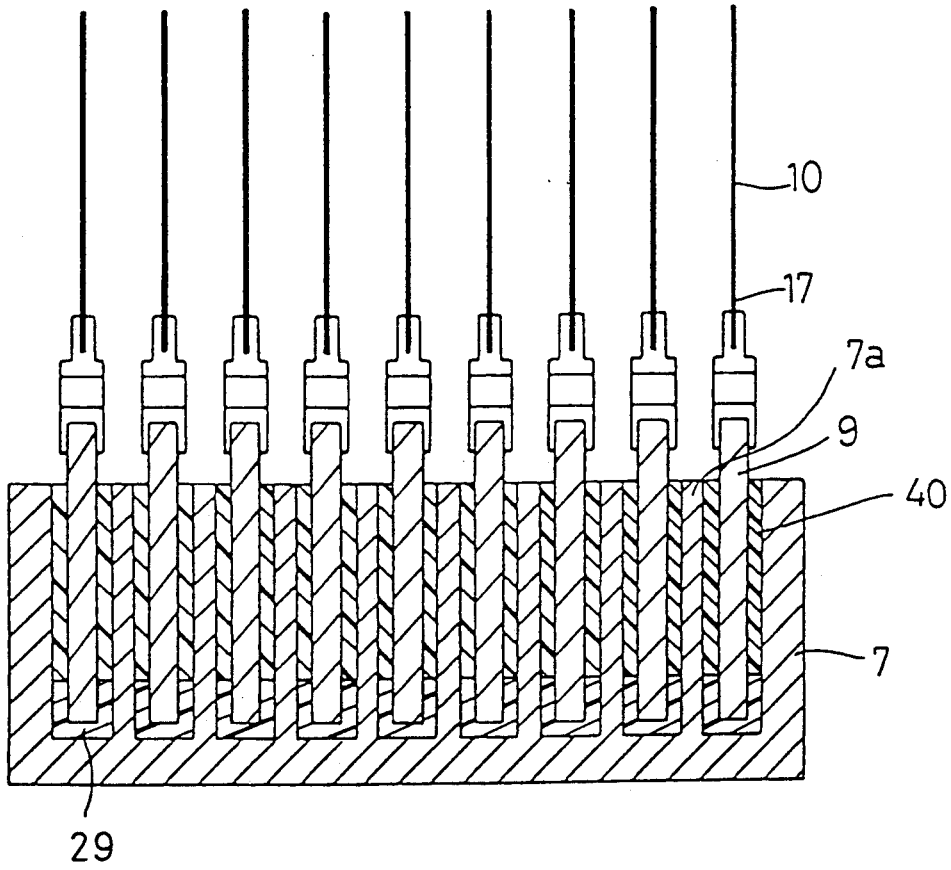
FIG. 12 is a cross-sectional view of a printing head of a fifth embodiment according to the invention.

A fifth embodiment of the invention will be explained with reference to FIG. 12. In the fifth embodiment, the invention is applied to a shuttle type line printing head. The cover 7 is formed in a rectangular shape. The plurality of print units 9 are bonded to the cover 7 by the adhesive 29, in a lateral arrangement. At the inner surface of the cover 7 are formed the projection pieces 7*a* projecting between the print units 9. The gaps between the print units 9 and the projection pieces 7*a* are filled with the silicone rubber 40 in the same manner as in the third embodiment described above.

In the above-mentioned third through fifth embodiments, the projection pieces 7*a* of the cover 7 intrude between the print units 9, to reduce the thickness of the thermoconductive synthetic resin that fills the gap between the print unit 9 and the projection pieces 7*a*. Therefore, the radiation effect can be enhanced without deterioration of the thermoconductivity of the thermoconductive synthetic resin.

What is claimed is:

1. A dot impact type printing head comprising:
a plurality of print units each of which has a piezoelectric element that extends upon application of a voltage, an extension transmitting mechanism for transmitting the extension of said piezoelectric element to a print wire, and a support frame having a fore portion and a rear portion for supporting said piezoelectric element and said extension transmitting mechanism;
a head unit to which the fore portion of each said support frame of each said print unit is fixed; and
a connector disposed across the rear portion of each said support frame of each said print unit, said connector being bonded to the rear portion of each said support frame by an adhesive.

2. The dot impact type printing head as claimed in claim 1, wherein said connector further comprises a plurality of projections that intrude between the rear portions of said support frames of said plurality of print units.

3. The dot impact type printing head as claimed in claim 2, wherein said adhesive further fills a portion of a gap between said rear portion of each said support frame and a pair of said projections adjacent said support frame.

4. The dot impact type printing head as claimed in claim 2, wherein said plurality of print units are arranged linearly.

5. The dot impact type printing head as claimed in claim 2, wherein said connector has a curvilinear profile and said plurality of print units are arranged uniformly along the profile.

6. A dot impact type printing head comprising:
a plurality of print units each of which has a piezoelectric element that extends upon application of a voltage, an extension transmitting mechanism for transmitting the extension of said piezoelectric element to a print wire, and a support frame having a fore portion, a rear portion, and side portions, said support frame supporting said piezoelectric element and said extension transmitting mechanism;
a head unit to which the fore portion of each said support frame of each said print unit is fixed;
a cover for covering said plurality of print
a plurality of projections formed in said cover, each of said projections intruding between said support frames of adjacent print units;
an adhesive filling between said projections and the rear portion of each said support frame; and
a thermoconductive resin filling between said projections and the side portions of each said support frame.

7. The dot impact type printing head as claimed in claim 6, wherein said adhesive comprises an epoxy resin.

8. The dot impact type printing head as claimed in claim 6, wherein said thermoconductive resin comprises a silicone rubber.

9. A dot matrix print head comprising:
a housing having at least two pieces, a head unit and a base unit;
a plurality of U-shaped support frames;
a plurality of print units, each of said print units having a piezoelectric element mounted in an associated U-shaped support frame, an extension transmission mechanism linked to the piezoelectric element at an open end of said associated U-shaped support frame, and a print wire attached to the transmission mechanism to extend through an opening in the print head, the base unit further comprising:

a plurality of projections extending from said base unit toward said head unit;

a plurality of grooves defined by said plurality of projections, each of said grooves for receiving a closed, rear end of the associated U-shaped support frame of one of said plurality of print units; and an adhesive means for partially filling the gap between the projections defining each of the grooves and the U-shaped support frame seated therein to create a reinforced print head assembly.

10. The dot matrix print head of claim 9, wherein said base unit includes an annular wall for connection to the head unit, a hollow interior produced thereby housing the plurality of print units.

11. The dot matrix print head as claimed in claim 9, wherein said plurality of projections are joined by inner and outer rings to change the plurality of grooves into a plurality of enclosed indentations, each of the plurality of enclosed indentations receiving the, rear end of one of said plurality of print units.

12. The dot matrix print head as claimed in claim 9, further comprising an outer cover that is attached to the head unit encloses the plurality of print units mounted in the base unit.

13. The dot matrix printer as claimed in claim 9, wherein said plurality of projections extend radially and are uniformly distributed around a circumference of the base unit.

14. The dot matrix printer as claimed in claim 9, wherein said base unit has a curvilinear profile and said plurality of print units are arranged uniformly along the profile.

15. The dot matrix printer as claimed in claim 9, wherein adhesive means comprises a thermoplastic resin.

16. The dot matrix printer, as claimed in claim 15, further comprising a silicone rubber for filling a remaining gap between the projections and the support frames and extending beyond the plurality of projections to fill between the plurality of print units.

17. The dot matrix printer as claimed in claim 15, wherein the thermoplastic resin comprises an epoxy resin.

18. The dot matrix printer as claimed in claim 15, wherein said plurality of print units are arranged linearly.

19. The dot matrix printer as claimed in claim 9, further comprising a thermoconductive means for extending beyond the plurality of projections to fill gaps between the plurality of print units.

20. The dot matrix printer as claimed in claim 19, wherein the thermoconductive means comprises a silicone rubber.

* * * * *